US005671721A

United States Patent [19]

Aoki

[11] Patent Number: 5,671,721

[45] Date of Patent: Sep. 30, 1997

[54] APPARATUS FOR DETERMINING THE CONDITION OF AN AIR-FUEL RATIO SENSOR

[75] Inventor: Keiichiro Aoki, Susono, Japan

[73] Assignee: Toyota Jidosha Kaisha, Aichi, Japan

[21] Appl. No.: 653,506

[22] Filed: May 24, 1996

[30] Foreign Application Priority Data

Jun. 1, 1995 [JP] Japan ..... 7-135084

[51] Int. Cl.[6] ..... F02D 41/14

[52] U.S. Cl. ..... 123/688; 123/697

[58] Field of Search ..... 123/688, 697; 204/425, 426

[56] References Cited

U.S. PATENT DOCUMENTS

| | | | |
|---|---|---|---|
| 4,938,196 | 7/1990 | Hoshi et al. | 123/697 |
| 4,958,611 | 9/1990 | Uchinami et al. | 123/697 |
| 5,036,820 | 8/1991 | Fujimoto et al. | 123/688 |
| 5,054,452 | 10/1991 | Denz | 123/688 |
| 5,111,792 | 5/1992 | Nagai et al. | 123/697 |
| 5,148,795 | 9/1992 | Nagai et al. | 123/697 |
| 5,172,677 | 12/1992 | Suzuki | 123/688 |
| 5,340,462 | 8/1994 | Suzuki | 123/688 |

FOREIGN PATENT DOCUMENTS

| | | |
|---|---|---|
| A-57-192852 | 11/1982 | Japan . |
| A-58-178248 | 10/1983 | Japan . |
| A-158335 | 6/1989 | Japan . |
| A-5-240829 | 9/1993 | Japan . |

*Primary Examiner*—Willis R. Wolfe
*Attorney, Agent, or Firm*—Oliff & Berridge

[57] ABSTRACT

An apparatus to determine whether or not an air-fuel ratio sensor is fully activated is provided. In the apparatus according to the present invention, first, the point of the start of the fluctuation of the output voltage of the air-fuel ratio sensor is detected, and thereafter the fully activated state of the air-fuel ratio sensor is determined by detecting the point when the accumulated value of the difference between the present heater resistance and the standard heater resistance after the above point of the start of the fluctuation of the output voltage of the air-fuel ratio sensor, exceeds a predetermined threshold.

4 Claims, 7 Drawing Sheets

APPARATUS FOR DETERMINING THE CONDITION OF AN AIR-FUEL RATIO SENSOR

BACKGROUND OF THE INVENTION

1. Field of the Invention

The present invention relates to an apparatus for determining the condition of an air-fuel ratio sensor and, more particularly, an apparatus for determining whether or not the air-fuel ratio sensor, which detects the air-fuel ratio of exhaust gas by detecting a limiting current which flows through a sensor element made of a solid electrolyte when voltage is impressed there on, is fully activated.

2. Description of the Related Art

Japanese Unexamined Patent Publication No. 5-240829 discloses an air-fuel ratio sensor for determining the air-fuel ratio of exhaust gas by detecting a limiting current which flows through a sensor element made of solid electrolyte when voltage is impressed there on and convert the limiting current to signal voltage. In the above described type of air-fuel ratio sensor, the limiting current varies in accordance with a change in the sensor element temperature as shown in FIG. 3.

As shown in FIG. 3, no limiting current flows until the sensor element temperature increases to some value. Then the limiting current begins to flow. The current increases in accordance with an increase in temperature, i.e. the sensitivity to a change in the air-fuel ratio increases in accordance with an increase in the temperature, and finally the current is stabilized when the temperature becomes higher than some value.

Therefore, it is required to activate the sensor as quickly as possible and correctly detect when the sensor is fully activated, i.e. the output characteristics of the sensor is stabilized, for reducing undesirable exhaust gases, especially at engine starting, since improving of the exhaust gases at engine starting becomes more important due to the recent strict emission gas regulations.

Accordingly, an air-fuel ratio sensor having a heater for quickly heating the sensor element is disclosed, for example, in the Japanese Unexamined Patent Publication No. 1-158335, and it is proposed to determine the active state of the air-fuel ratio sensor by accumulating the consumed electricity.

However, in practice, the sensor temperature is effected not only by heat discharged by the heater but also exhaust gas. Therefore, the above described determining of the active state of the air-fuel ratio sensor by accumulating the consumed electricity has poor accuracy since the effect of exhaust gas is neglected. In addition to the above, the sensor activating temperature changes and the accuracy of the air-fuel ratio sensor will decrease when the sensor element deteriorates and the inner resistance increases or the sensitivity decreases.

Another apparatus which determines the activation by detecting the inner resistance of the sensor by impressing a voltage on the sensor is disclosed in, for example, Japanese Unexamined Patent Publication No. 57-192852 and Japanese Unexamined Patent Publication No. 58-178248. However, these apparatuses require expensive sophisticated electric circuits and the sensing period of the air-fuel ratio of these apparatuses is interrupted by the detection of the inner resistance if the limited current and inner resistance are alternatively detected.

SUMMARY OF THE INVENTION

Therefore, an object of the present invention is to provide an apparatus which can determine the state of an air-fuel ratio sensor at low cost and with high accuracy.

According to the present invention there is provided an apparatus for determining the activation of an air-fuel ratio sensor, disposed in an exhaust passage of an internal combustion engine for detecting air-fuel ratio of exhaust gas, which comprises a heater for heating the air-fuel ratio sensor, means for detecting a resistance of the heater, means for detecting a starting point of fluctuation of an output of the air-fuel ratio sensor, means for accumulating a difference between the resistance detected by the means for detecting a resistance of the heater and standard resistance of the heater, and means for determining the activation of the air-fuel ratio sensor when the accumulated difference between the resistance detected by the means for detecting a resistance of the heater and standard resistance of the heater exceeds a predetermined threshold.

The present invention will be more fully understood from the description of the preferred embodiments of the invention set forth below, together with the accompanying drawings.

DESCRIPTION OF THE PREFERRED EMBODIMENTS

Figure 1:
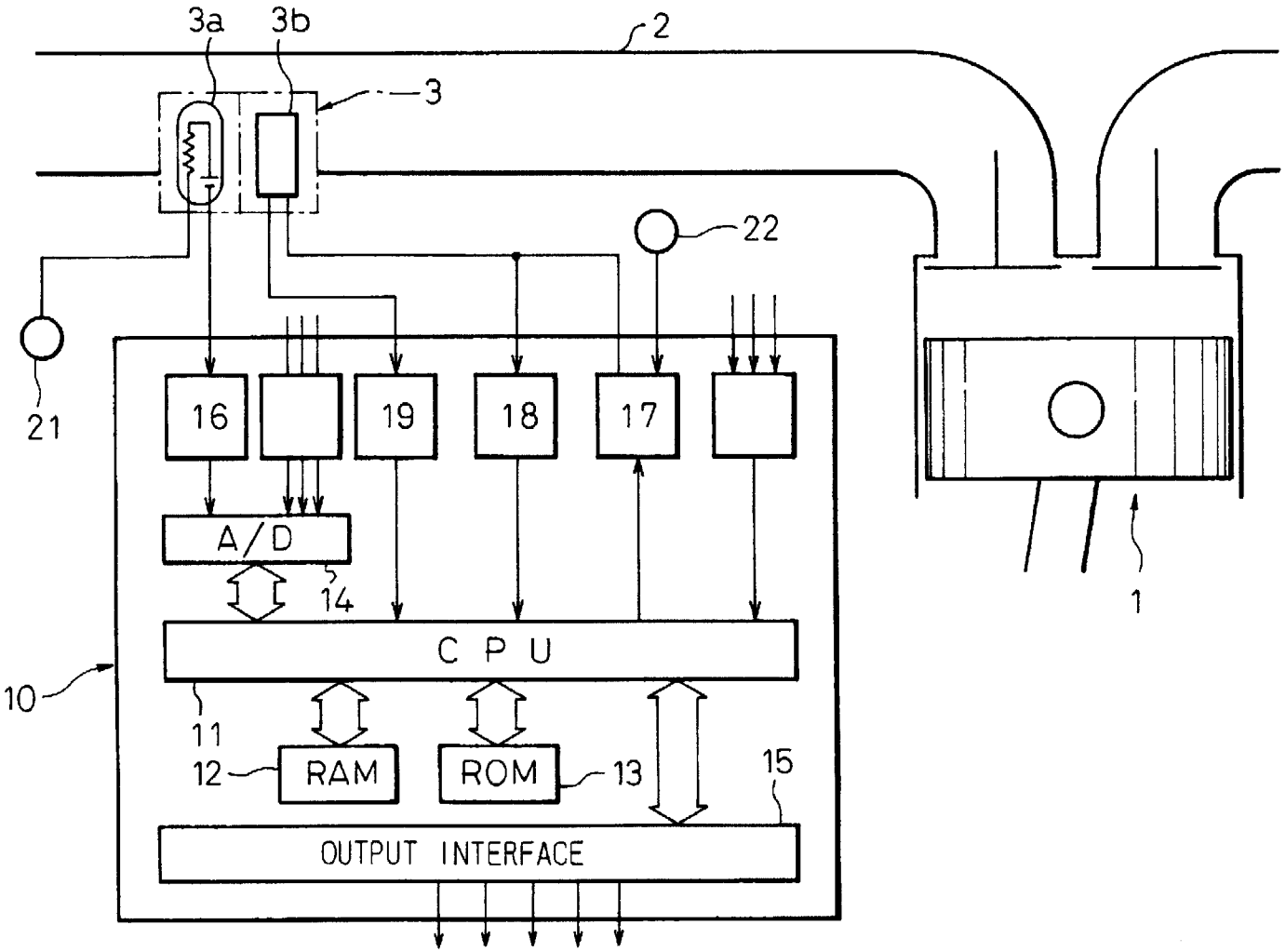
FIG. 1 is a schematic view of a structure of embodiment of the present invention.

FIG. 1 schematically shows a structure of the first embodiment of the present invention. This structure is also used in the second and the third embodiments. In FIG. 1, an air-fuel ratio sensor 3 is attached to an exhaust gas passage 2 extending from an internal combustion engine 1. The air-fuel ratio sensor 3 comprises a sensor element 3*a* composed of solid electrolyte and a heater 3*b* for heating the sensor element 3*a*.

An engine control computer (ECU) 10 is constructed as a digital computer comprising a CPU (microprocessor) 11, RAM (random access memory) 12, ROM (read only memory) 13, an ADC (analog-digital converter) 14 and an output interface 15 which are interconnected to each other.

This embodiment further comprises the following circuits.

The first circuit is a drive circuit 16, for regulating electric supply to heater 3*b*, which comprises a resistance for detecting current which flows through the sensor element 3*a* and an amplifier to suitably amplify the voltage drop across the resistance. The voltage is converted by the drive circuit 16 and is input to the CPU 11 through the ADC 14.

The second circuit is a regulating circuit 17 for regulating the electric supply to the heater 3*b*, which regulates the voltage supplied by the source for the heater 22 to the heater 3*b*.

The third circuit is a voltage detecting circuit 18 for detecting a voltage drop across the heater 3b when an electric current is supplied.

The fourth circuit is a current detecting circuit 19 for detecting a current which flows through the heater 3b when an electric current is supplied.

The CPU 11 determines whether or not the air-fuel ratio sensor 3 is fully activated by executing a calculation, which is described later, based upon signals from the above described circuits.

Of course, signals from other not shown sensors are input to the CPU 11 of the ECU 10 directly or through the ADC 14, and signals for controlling the fuel injection, ignition timing and others are output through the output interface 15.

The above constructed embodiment of the present invention operates according to a principle which is described below with reference to FIG. 2.

Figure 2:
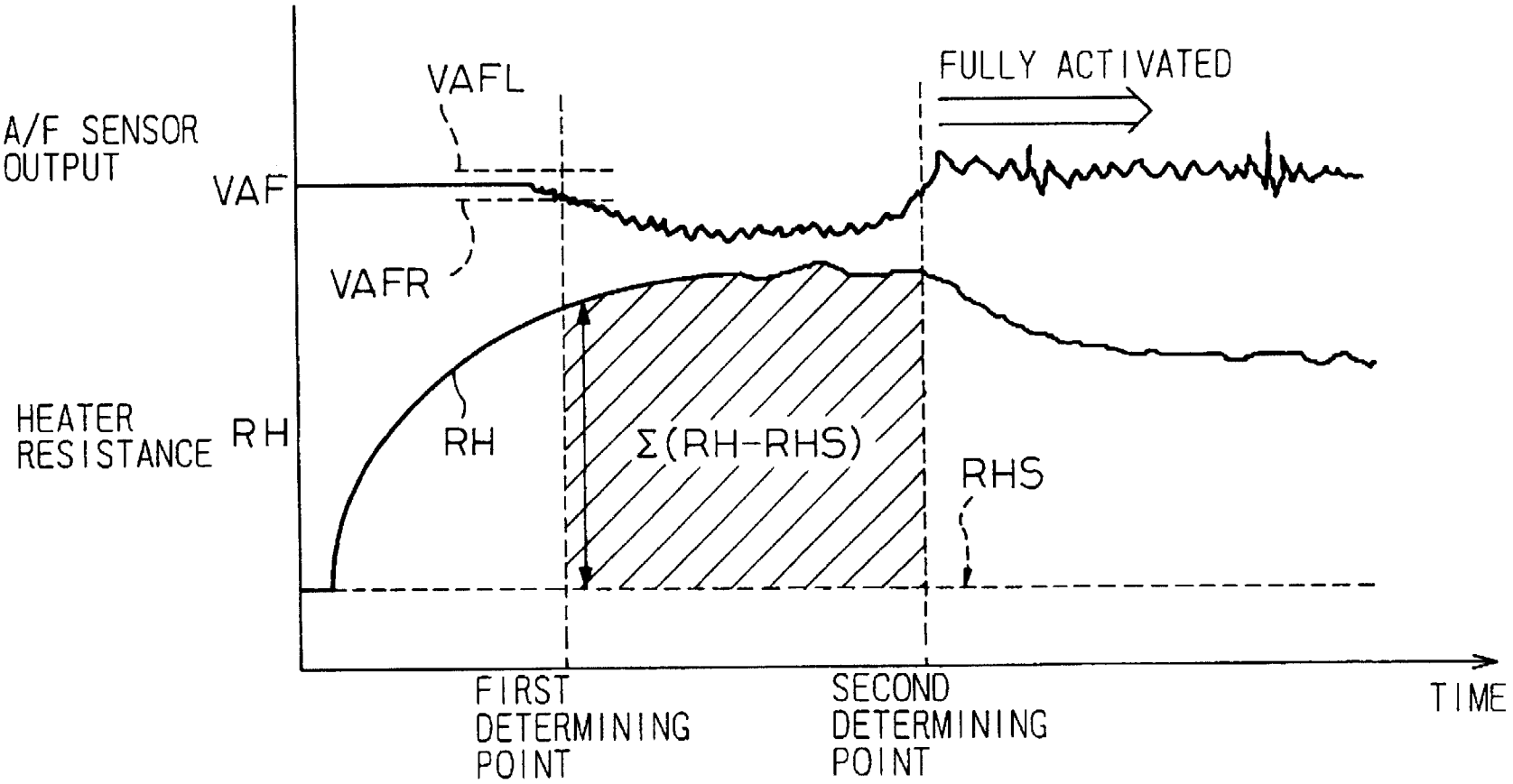
FIG. 2 is a time chart showing changes of a heater resistance and a sensor output after engine starting.

FIG. 2 shows changes of a resistance of the heater 3b of the air-fuel ratio sensor 3 and sensor output relative to the elapsed time from engine starting.

Electric current supply to the heater 3b of the air-fuel ratio sensor 3 is started when the engine 1 is started. The temperature of the heater 3b increases due to the heat from heater 3b itself and from the exhaust gas and the resistance of the heater 3b increases in accordance with the increase in the temperature.

On the other hand, for a while no limiting current flows because the temperature of the sensor element 3a is low and the air-fuel ratio sensor 3 outputs a voltage which is same as the voltage output when the engine 1 is operated with a stoichiometric air-fuel ratio.

The reason why the voltage output from air-fuel ratio sensor 3 is same as the one when the engine is operated with a stoichiometric air-fuel ratio is described below.

The drive circuit 16 installed in this embodiment has a construction the same as the one disclosed in the Japanese Unexamined Patent Publication No. 5-240829, in which a voltage potential on the exhaust gas side of the sensor element 3a is set higher than the ground level of the drive circuit 16 and the sensor output voltage $E_0$ is expressed as follows:

$$E_0=V_0+V_R+I\times R \quad (1)$$

wherein, $V_0$ is a voltage potential $V_R$ is an impressed voltage

I is a current which flows through the sensor element 3a

R is a resistance for converting the limiting current to a voltage

Therefore, the sensor output voltage $E_0=V_0+V_R$ when the temperature of sensor element 3b is low and no limiting current flows and accordingly I is zero.

On the other hand, the formula (1) also can be expressed as follows:

$$E_0=V_0+V_R+K\times(\lambda-1)\times R \quad (2)$$

wherein,

K is a proportional constant $\lambda$ is an excess air ratio

Therefore, if the engine is operated with an excess air ratio $\lambda=1$, i.e. with stoichiometric air-fuel ratio, the sensor output voltage $E_0=V_0+V_R$, since $\lambda-1=0$.

Thus, the sensor output voltage which is output, when the temperature of sensor element 3b is low and no limiting current flows, is same as the one when the engine is operated with stoichiometric air-fuel ratio.

When, after a while, the temperature of the sensor element 3b exceeds the output start temperature, the output voltage of the air-fuel ratio sensor 3 begins to fluctuate.

The above initial fluctuation has the following peculiarities.

One is that the output voltage fluctuates finely without keeping its mean value at a constant value before the beginning of the fluctuation but shifts its mean value from the constant value before the beginning of the fluctuation. This is because engine 1 is operated with the rich shifted air-fuel ratio after a cold start.

The other is that amplitude of the initial fluctuation is small. This is because, as shown in FIG. 3, a limiting current which flows through the sensor element 3a hardly changes relative to the change of air-fuel ratio of the exhaust gas until the sensor element 3a is sufficiently warmed up to be fully activated.

Figure 3:
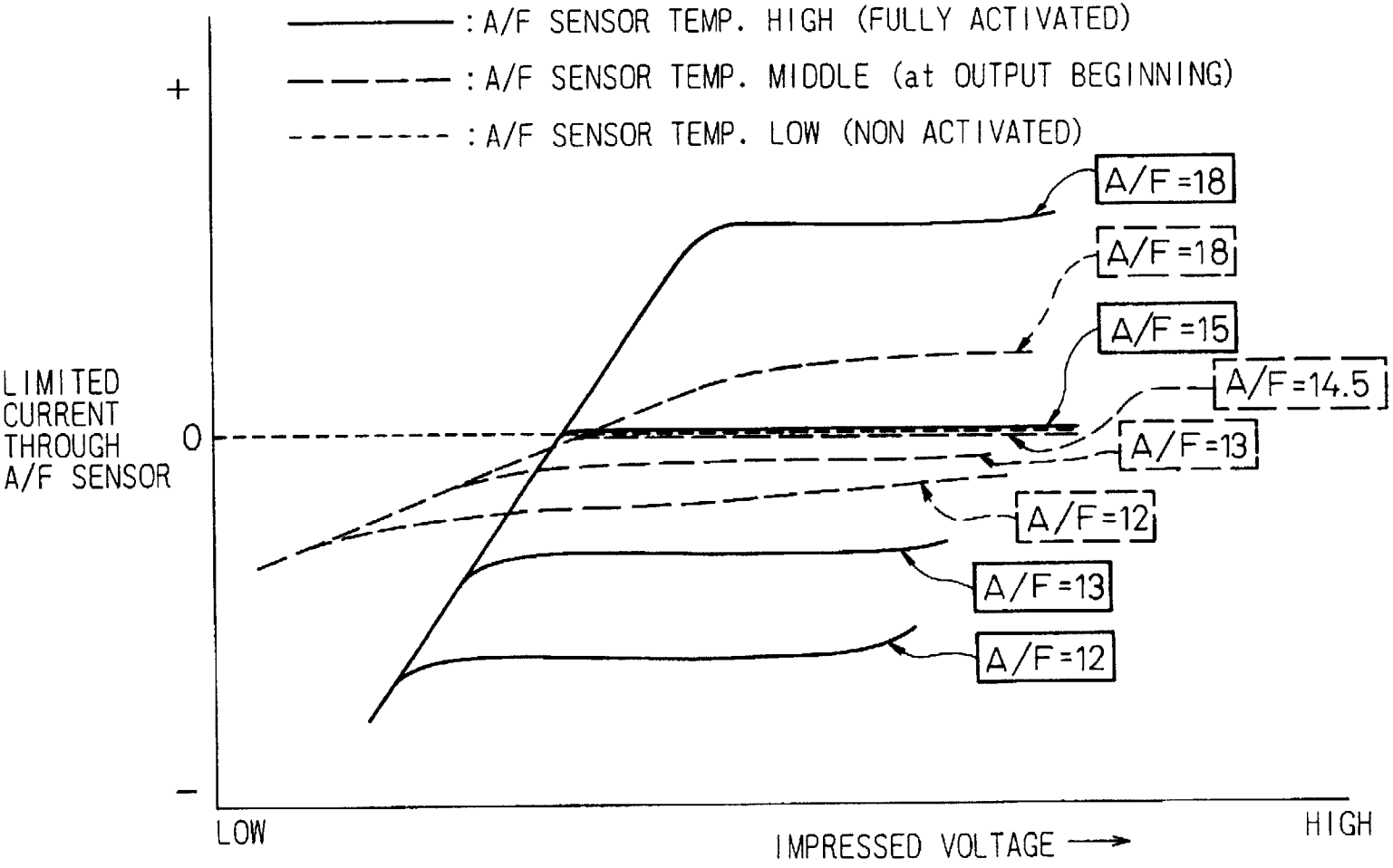
FIG. 3 shows limiting current which flows through an air-fuel ratio sensor at various states.

When the sensor element 3a is sufficiently warmed up to be fully activated, the limiting current changes considerably relative to the change of air-fuel ratio of the exhaust gas as shown by the real line in FIG. 3, and accordingly the output voltage of the air-fuel ratio sensor 3b also fluctuates.

Here, we denote the point where the sensor element 3a of the air-fuel ratio sensor 3 reaches the output start temperature, and the output voltage begins to fluctuate, as the first determining point.

We denote the point where the sensor element 3a is fully activated and the output signal begins to fluctuate considerably, relative to the change of air-fuel ratio of the exhaust gas, as the second determining point.

Then, we can define the second determining point when the heat received after the first determining point reaches some value.

The first determining point is obtained as follows.

As aforesaid, the output voltage keeps a constant value until the sensor element 3a of the air-fuel ratio sensor 3 exceeds the output start temperature, and begins to fluctuate finely and shifts from the constant value before beginning the fluctuating after the sensor element 3a of the air-fuel ratio sensor 3 exceeds the output start temperature. Therefore, the point when the output voltage deviates beyond some predetermined width is denoted as the first determining point. For example, the point when the air-fuel ratio deviates outside the band between 14.2 and 14.8 is denoted as the first determining point, since the constant value before the beginning of the fluctuation, which is same as the stoichiometric air-fuel ratio, is assumed to be 14.5.

The second determining point is obtained as follows.

The heater 3b is heated not only by the heater itself but also by the exhaust gas and thereby the temperature of the heater 3b increases and, accordingly, the heater resistance changes. Thus the total amount of the absorbed heat is reflected in the heater resistance.

Therefore, in the embodiment of the present invention, the second determining point is defined when the accumulated value of the difference between the resistance of the heated heater and resistance of heater in a standard condition, for example at 20° C. in this embodiment, exceeds a threshold which is decided on the basis of the results of experiments.

In the above described method, the increase in the heater temperature by the heating by the heater itself and by the exhaust gas is reflected in the accumulated value of the difference between the resistance of heated heater and resistance of heater in a standard condition. Therefore, the second determining point which indicates that the air-fuel ratio sensor 3 is fully activated can be detected with high accuracy.

The high accuracy can be kept even if the air-fuel ratio sensor 3 deteriorates and the characteristic, against temperature, of the air-fuel ratio sensor 3 changes, as described below.

If the air-fuel ratio sensor 3 deteriorates, the first determining point and the second determining point both shift to the right in FIG. 2. However, the shift of the second determining point is caused by the shift of the first determining point, i.e. the shift of the first determining point is accompanied by the shift of the second determining point.

A description on a control operation of the first embodiment to detect the fully activated state of the air-fuel ratio sensor 3 will now be given with referring flow charts shown in FIGS. 4 and 5.

Figure 4:
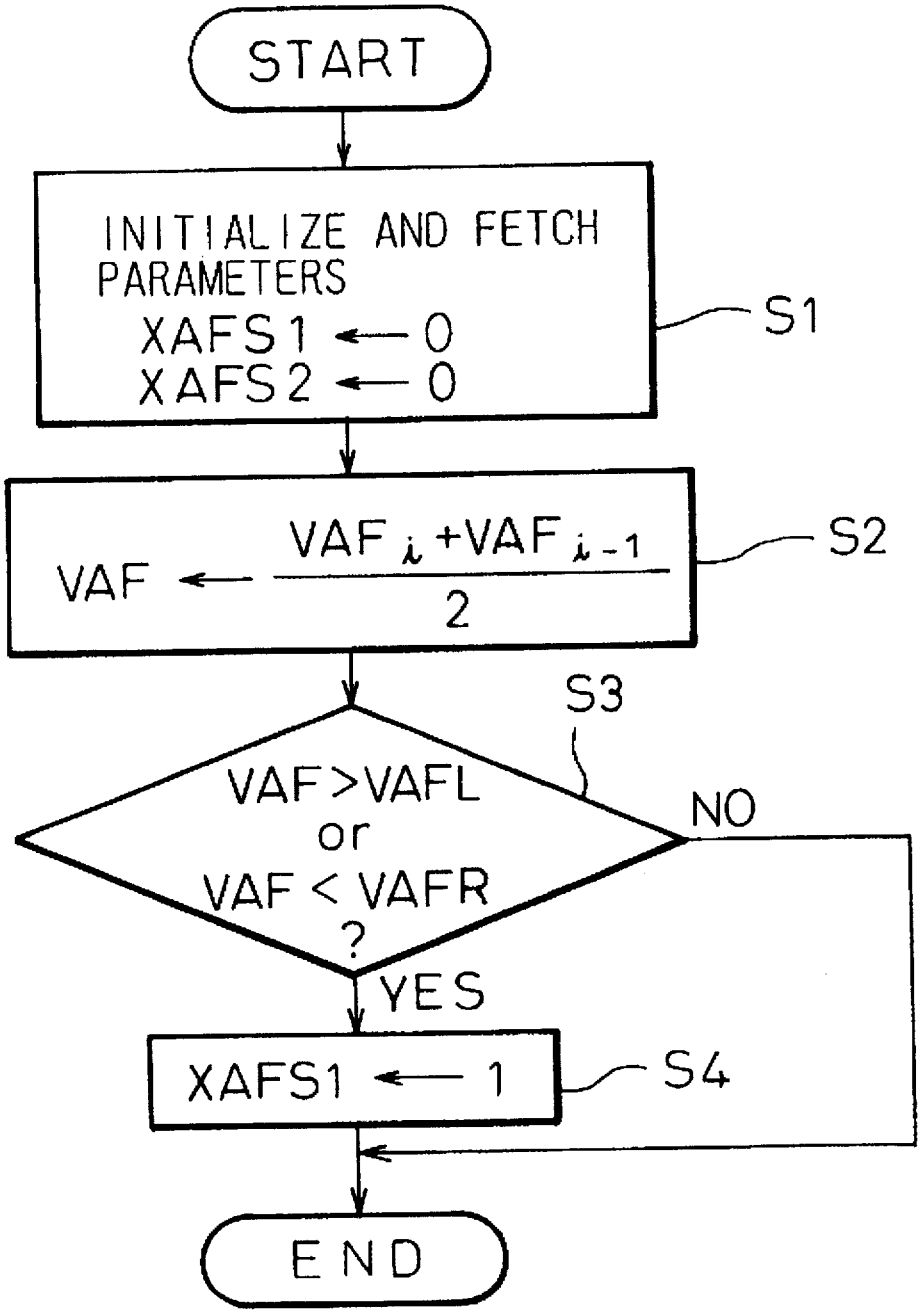
FIG. 4 is a flow chart of a routine executed in the first embodiment.

FIG. 4 is a flow chart of a routine to obtain the above described first determining point. This routine is executed based upon an output voltage which is obtained from the limiting current, which flows in the air-fuel ratio sensor 3, through a conversion to a voltage signal by the driving circuit 16 and digitalization by the ADC 14.

At step 1, flags XAFS1 and XAFS2 and the parameters required for the control, which are stored in RAM 12, are initialized and fetched. The flag XAFS1 indicates whether the air-fuel ratio sensor 3 has reached the output start temperature and the flag XAFS2 indicates whether the air-fuel ratio sensor 3 is fully activated or not.

At step 2, VAF (output of air-fuel ratio sensor 3) is gradated.

In this embodiment, as shown, the gradation is executed by averaging $VAF_1$, (newly fetched VAF) and $VAF_{i-1}$ (one before fetched VAF), however other suitable gradation methods can also, of course, be employed.

At step 3, it is determined whether or not the air-fuel ratio sensor 3 has reached the output start temperature by determining whether the above gradated VAF exceeds either a rich side threshold VAFR or a lean side threshold VAFL, or neither of them.

The rich side threshold VAFR and the lean side threshold VAFR are preliminary set in ECU 10, and each has a value corresponding to A/F ratio =14.2 and A/F ratio =14.8, respectively, when the stoichiometric A/F ratio is assumed to 14.5.

If the air-fuel ratio sensor 3 reaches the output start temperature, the routine proceeds to step 4 and sets flag XAFS1 (="1"), and then ends.

If the air-fuel ratio sensor 3 does not reach the output start temperature, the routine ends without proceeding to other steps.

Figure 5:
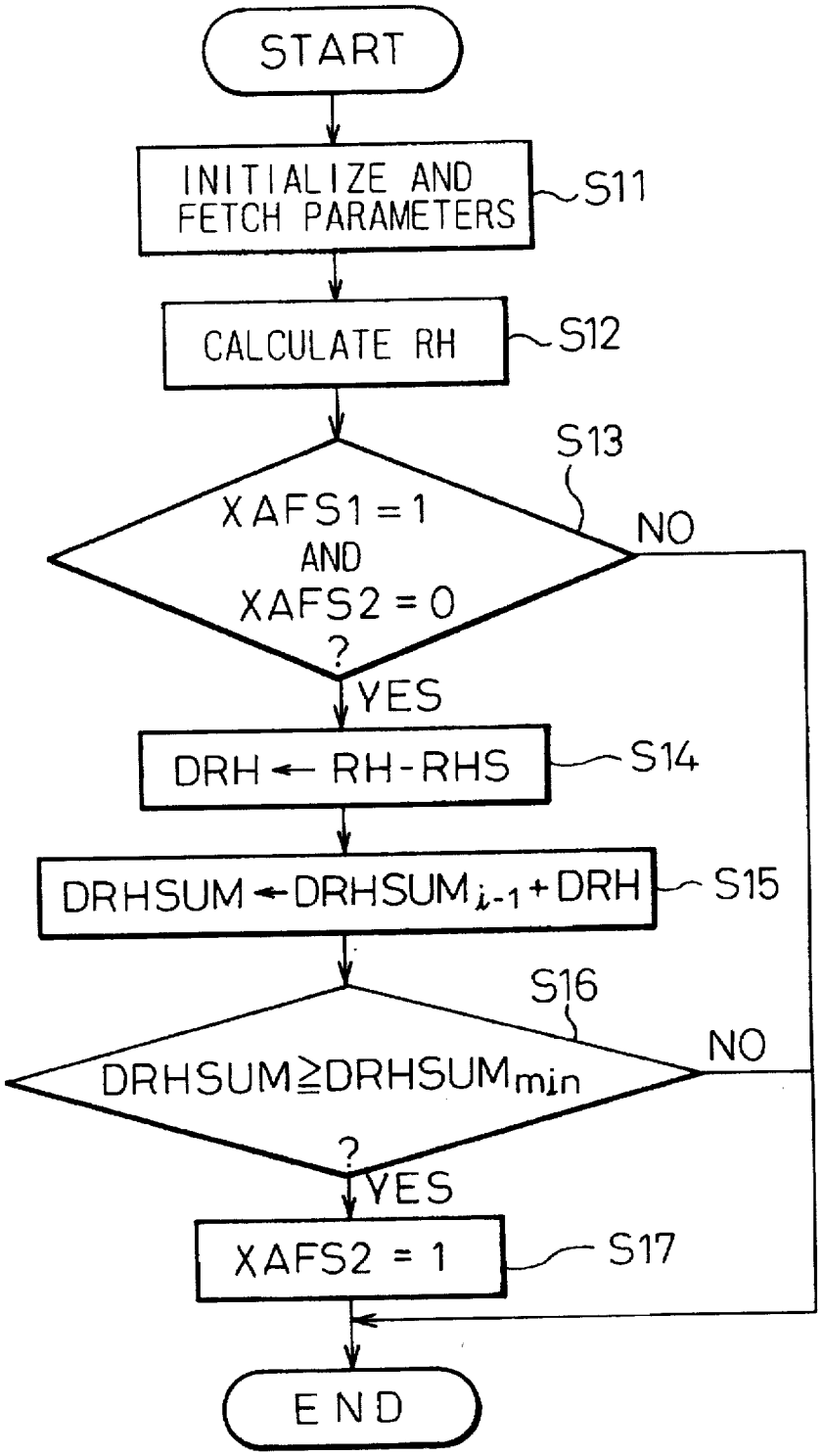
FIG. 5 is a flow chart of a routine executed in the first embodiment.

FIG. 5 is a flow chart of a routine to obtain the second determining point which indicates that the air-fuel ratio sensor 3 is fully activated by accumulating the difference between the present heater resistance and the standard heater resistance.

At step 11, the required parameters are initialized and fetched.

At step 12, heater resistance RH is calculated from the voltage across terminals of the heater.

At step 13, it is determined whether or not the flag XAFS1 is set to "1" and the flag XAFS2 is set (="1") to judge the need for proceeding to other steps.

If the routine must proceed to other steps, the routine proceeds to step 14.

At step 14, the difference DRH between the present heater resistance RH and the standard heater resistance RHS is calculated.

At step 15, the accumulated resistance difference DRHSUM is updated by adding the above calculated present resistance difference DRH onto the old accumulated resistance difference $DRHSUM_{i-1}$.

At step 16, it is determined whether or not the updated accumulated resistance difference DRHSUM exceeds the preliminary set threshold $DRHSUM_{min}$.

If it is determined to be "yes", i.e. the updated accumulated resistance difference DRHSUM exceeds the threshold $DRHSUM_{min}$, the routine proceeds to step 17 to set ("1") the flag XAFS2, and then the routine is ended.

Figure 6:
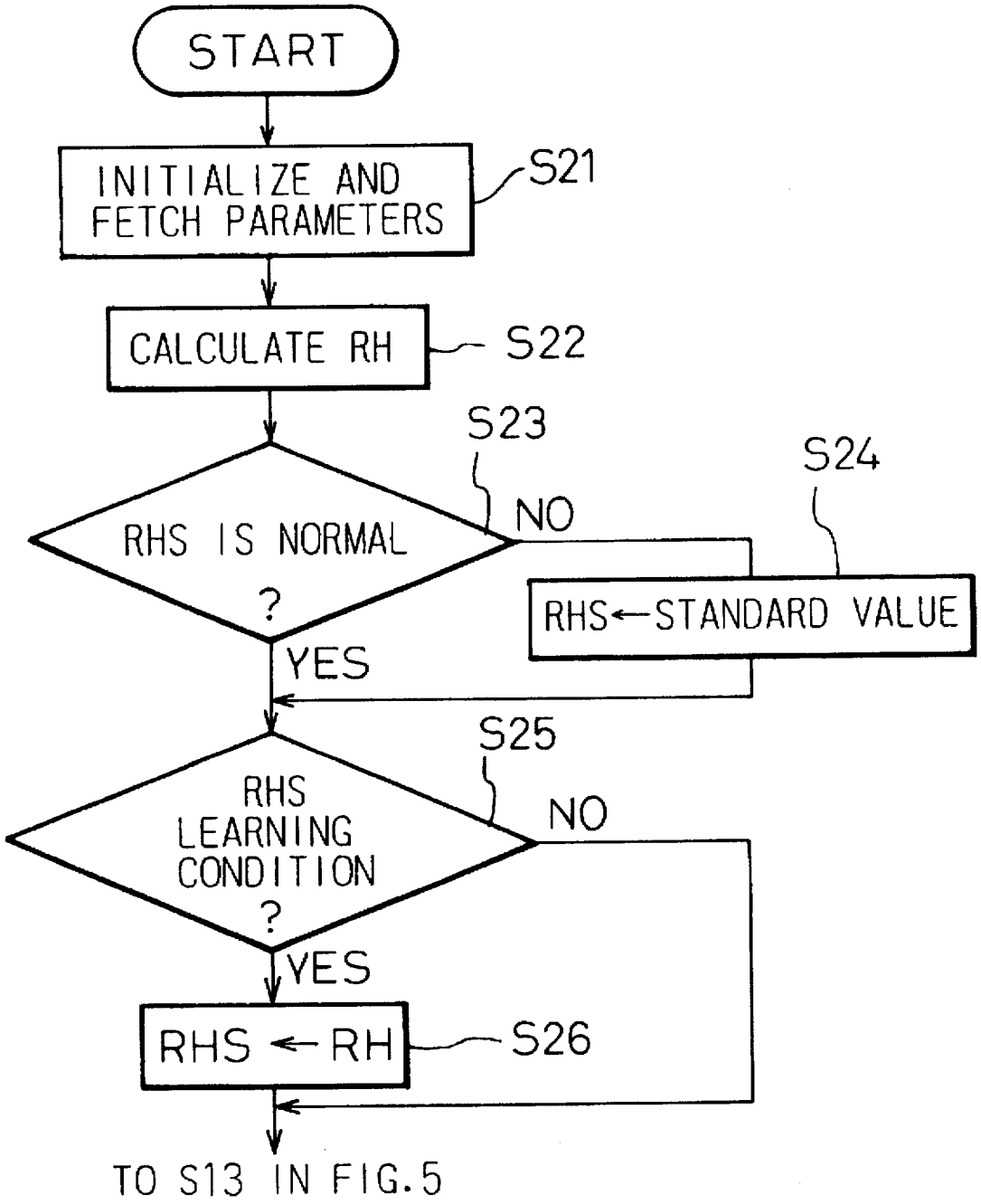
FIG. 6 is a flow chart of a routine executed in the second embodiment.

FIG. 6 shows a flow chart of a routine executed by the second embodiment in which the standard heater resistance RHS is updated by learning method to eliminate the effect of a variation of resistance generated during manufacturing and to thereby obtain higher accuracy in the accumulated resistance difference DRHSUM.

At step 21 and 22, the required parameters are initialized and fetched and the heater resistance RHS is calculated as in step 11 and 12 of the flow chart shown in FIG. 5.

At step 23, it is determined whether or not the heater resistance RHS which was learned from the last calculation and was stored in the RAM 12 has an irregular value.

If the RHS does not have irregular value the routine directly proceeds to step 25, and if the RHS has irregular value the routine proceeds to step 25 after setting RHS to a predetermined initial value, for example, 1Ω, at step 24.

At step 25, it is determined whether or not the conditions for learning the RHS are fulfilled.

The conditions for learning are, for example, that the elapsed time after turning ON the ignition switch is less than a predetermined value, that the temperature of a cooling water of the engine 1 is lower than a predetermined value, that the intake manifold vacuum is less than a predetermined value, that the output of the air-fuel ratio sensor is 0, that an engine speed is less than a predetermined value, that the engine in operating in an idle state, and others.

Therefore, the condition for learning the RHS can be fulfilled shortly after the beginning of supplying the electricity to the heater which accompanies the starting of the engine 1 in a fully cold condition.

If the condition for learning the RHS is fulfilled the routine proceeds to the step 26.

At the step 26, the standard heater resistance RHS is calculated on the basis of the heater resistance RH which is calculated at step 22 on the basis of detected heater resistance.

The calculated value is stored as the new value of RHS.

After the execution of step 26, the steps after step 13 in the flow chart shown in FIG. 5 are executed.

As described above, in the second embodiment the effect of a variation in the heater resistance generated during manufacturing can be detected, whereby a higher accuracy is obtained.

Figure 7:
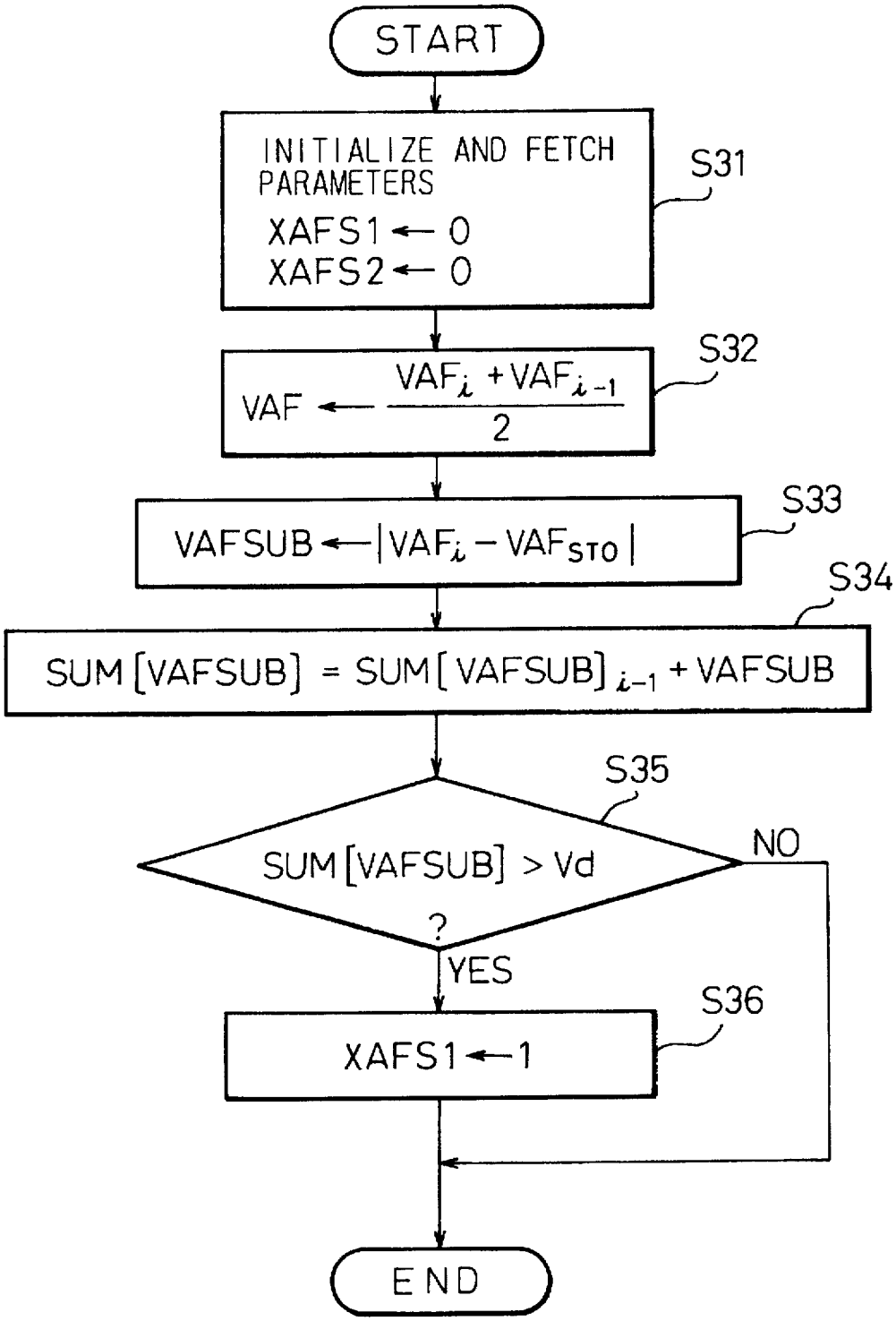
FIG. 7 is a flow chart of a routine executed in the third embodiment.

FIG. 7 shows a flow chart of a routine, executed in the third embodiment, in which the absolute value of the deviation of the output voltage of the air-fuel ratio sensor 3 from the standard output voltage, i.e. the output when the engine is operated with stoichiometric air-fuel ratio, is accumulated, and the point when the accumulated value exceeds a predetermined threshold is defined as the first determining point.

At step 31, as in step 1 of the flow chart shown in FIG. 4, the required parameters and flags XAFS1 and XAFS2 are initialized and fetched.

At step 32, as in step 2 in the flow chart shown in FIG. 4, the gradated value of the output voltage VAF of the air-fuel ratio sensor 3 is calculated.

At step 33, the absolute value VAFSUB of the difference between the above gradated output voltage VAF of the air-fuel ratio sensor 3 and $VAF_{s1o}$, which is an output voltage of the air-fuel ratio sensor 3 when the engine 1 is operated with stoichiometric air-fuel ratio is calculated.

At step 34, VAFSUB is accumulated to obtain the accumulated value thereof SUM [VAFSUB].

At step 35, it is determined whether or not the SUM [VAFSUB]exceeds the predetermined threshold Vd.

If the SUM [VAFSUB] exceeds the above predetermined value Vd, the routine proceed to the step 36 to set ("1") the flag XAFS1.

If the SUM [VAFSUB] does not exceed the Vd, the routine will end.

In this third embodiment the first determining point is detected as described above, therefore the first determining point can be detected even if the engine is operated with stoichiometric air-fuel ratio.

As described above, in the present invention, first, the point of the start of the fluctuation of the output voltage of the air-fuel ratio sensor is detected, and thereafter the fully activated state of the air-fuel ratio sensor is determined by detecting the point when the accumulated value of the difference between the present heater resistance and the standard heater resistance from the above point of the start of the fluctuation of the output voltage of the air-fuel ratio sensor until the accumulated value exceeds a predetermined threshold.

Therefore no means for detecting a temperature of the air-fuel ratio sensor, nor the sophisticated circuit for measuring the inner resistance of the air-fuel ratio sensor, is required, and accordingly, the required cost is low.

The increase of the temperature by the heating by the heater itself and the heating by the exhaust gas are both reflected in the heater resistance, therefore the fully activated point can be defined with higher accuracy.

Further, the higher accuracy of the defining of the fully activated point can be maintained even if the characteristic, against the temperature, of the air-fuel ratio sensor is changed, for example, by a deterioration of the air-fuel ratio sensor.

I claim:

1. An apparatus for determining fully activated state of an air-fuel ratio sensor disposed in an exhaust passage of an internal combustion engine for detecting air-fuel ratio of exhaust gas comprising;

a heater for heating said air-fuel ratio sensor;

means for detecting a resistance of said heater;

means for detecting a starting point of fluctuation of an output of said air-fuel ratio sensor;

means for accumulating a difference between the resistance detected by said means for detecting a resistance of said heater and predetermined standard resistance of said heater; and means for determining a fully activated state of said air-fuel ratio sensor when said accumulated difference between the resistance detected by said means for detecting a resistance of said heater and standard resistance of said heater exceeds a predetermined threshold.

2. An apparatus as claimed in claim 1, wherein the means for detecting a starting point of fluctuation of an output of said air-fuel ratio sensor detects the point when the output of said air-fuel ratio sensor shifts beyond a predetermined band.

3. An apparatus as claimed in claim 1, wherein the means for detecting a starting point of fluctuations of an output of said air-fuel ratio sensor detects the starting point of fluctuations when the accumulated value of the absolute value of the deviation of the output of said air-fuel ratio sensor exceeds a predetermined value.

4. An apparatus as claimed in claim 1, wherein said standard resistance of said heater is updated by learning.

* * * * *

UNITED STATES PATENT AND TRADEMARK OFFICE

CERTIFICATE OF CORRECTION

PATENT NO. : 5,671,721

DATED : September 30, 1997

INVENTOR(S) : Keiichiro AOKI

It is certified that error appears in the above-indentified patent and that said Letters Patent is hereby corrected as shown below:

ON THE TITLE PAGE:

[73] Assignee: Please change "Toyota Jidosha Kaisha" to --Toyota Jidosha Kabushiki Kaisha--.

Signed and Sealed this

Twenty-fifth Day of November, 1997

*Attest:*

Bruce Lehman

BRUCE LEHMAN

*Attesting Officer*

*Commissioner of Patents and Trademarks*